US008960737B2

(12) United States Patent
Nazzari

(10) Patent No.: US 8,960,737 B2
(45) Date of Patent: Feb. 24, 2015

(54) LOCK BOLT

(71) Applicant: NIC Products Inc., Walnut Creek, CA (US)

(72) Inventor: Ian A. Nazzari, Moraga, CA (US)

(73) Assignee: NIC Products Inc., Walnut Creek, CA (US)

( * ) Notice: Subject to any disclaimer, the term of this patent is extended or adjusted under 35 U.S.C. 154(b) by 0 days.

(21) Appl. No.: 13/864,633

(22) Filed: Apr. 17, 2013

(65) Prior Publication Data

US 2013/0277989 A1 Oct. 24, 2013

Related U.S. Application Data

(60) Provisional application No. 61/635,565, filed on Apr. 19, 2012.

(51) Int. Cl.

| | |
|---|---|
| ***E05B 39/02*** | (2006.01) |
| ***G09F 3/03*** | (2006.01) |
| *B65D 55/06* | (2006.01) |

(52) U.S. Cl.

CPC ..... *B65D 55/06* (2013.01); *G09F 3/0317* (2013.01)

USPC ..... 292/327; 292/307 R

(58) Field of Classification Search

CPC ..... E05B 39/02; G09F 3/0317; G09F 3/0352

USPC ..... 292/307 R, 327

See application file for complete search history.

(56) References Cited

U.S. PATENT DOCUMENTS

| | | | |
|---|---|---|---|
| 210,641 | A | 12/1878 | Smith et al. |
| 409,034 | A | 8/1889 | Gillespie |
| 511,642 | A | 12/1893 | Nadon |
| 998,878 | A | 7/1911 | Dinsmoor |
| 1,054,440 | A | 2/1913 | Murray |
| 1,059,689 | A | 4/1913 | Webb |
| 1,079,839 | A | 11/1913 | Ciernia |

(Continued)

FOREIGN PATENT DOCUMENTS

| | | | |
|---|---|---|---|
| DE | 2262421 | A1 | 7/1973 |
| EP | 0 537 400 | A1 | 4/1993 |

(Continued)

OTHER PUBLICATIONS

ISR & Written Opinion received in PCT/US2013/036969, filed on Apr. 17, 2013.

(Continued)

*Primary Examiner* — Carlos Lugo

(74) *Attorney, Agent, or Firm* — Workman Nydegger

(57) ABSTRACT

A security lock bolt for sealing objects against unauthorized access includes a lock bolt having two bolt locking features that cooperate with two locking features that cooperate with a locking cylinder and transparent cap member secured to the locking cylinder, respectively. The bolt locking feature cooperating with the locking cylinder secures the bolt from unauthorized separation from the locking cylinder and the locking feature that cooperates with the transparent cap is visible to an observer outside the cylinder and locks the bolt against separation from the transparent cap member. The transparent cap locking arrangement provides an indication of full locking of the lock bolt within the locking cylinder. The bolt locking feature associated with the transparent cap member is integrated with an overmolded bolt body casing.

6 Claims, 5 Drawing Sheets

(56) References Cited

U.S. PATENT DOCUMENTS

| | | | | |
|---|---|---|---|---|
| 1,131,085 | A | 3/1915 | Reilly | |
| 1,132,970 | A | 3/1915 | Peyton | |
| 1,381,975 | A | 6/1921 | Dumais | |
| 1,512,632 | A | 10/1924 | O'Connor | |
| 1,626,273 | A | 4/1927 | Dietze | |
| 1,647,398 | A | 11/1927 | Draheim et al. | |
| 1,727,754 | A | 9/1929 | Dessauer | |
| 1,863,041 | A | 6/1932 | Dessauer | |
| 1,878,991 | A | 9/1932 | Murray | |
| 1,945,965 | A | 2/1934 | Behrman | |
| 1,964,014 | A | 6/1934 | Wenk | |
| 1,964,987 | A | 7/1934 | Wenk | |
| 1,982,438 | A | 11/1934 | Keidel | |
| 1,987,351 | A | 1/1935 | Rose | |
| 1,987,737 | A | 1/1935 | Goddard | |
| 2,020,198 | A | 11/1935 | Miller | |
| 2,497,434 | A | 2/1950 | Borland | |
| 2,587,876 | A | 3/1952 | Moore | |
| 2,599,700 | A | 6/1952 | Di Palma | |
| 2,809,065 | A | 10/1957 | Erke | |
| 3,375,033 | A | 5/1966 | Moberg | |
| 3,367,701 | A | 2/1968 | Wenk, Jr. | |
| 3,591,223 | A | 7/1971 | Castro Neto | |
| 3,712,655 | A | 1/1973 | Fuehrer | |
| 3,736,017 | A | 5/1973 | Kaiho | |
| 3,841,118 | A | 10/1974 | Stone | |
| 3,954,294 | A | 5/1976 | Iwamoto et al. | |
| 3,980,332 | A | 9/1976 | King, Sr. | |
| 3,987,653 | A | 10/1976 | Lyon et al. | |
| 4,106,801 | A | 8/1978 | Castro Neto | |
| 4,175,782 | A | 11/1979 | Castro Neto | |
| 4,502,305 | A | 3/1985 | Bakker | |
| 4,512,599 | A | 4/1985 | Castro Netto | |
| 4,687,240 | A | 8/1987 | Swift | |
| 4,722,562 | A | 2/1988 | Burt | |
| 4,733,893 | A | 3/1988 | Davis et al. | |
| 4,736,604 | A | 4/1988 | Zeller et al. | |
| 4,775,175 | A | 10/1988 | Swift | |
| 4,782,613 | A | 11/1988 | Guiler et al. | |
| 4,793,641 | A | 12/1988 | Sokol | |
| 4,793,644 | A | 12/1988 | Swift | |
| 4,802,700 | A | 2/1989 | Stevenson et al. | |
| 4,818,002 | A | 4/1989 | Castro Netto | |
| 4,832,387 | A | 5/1989 | Guiler | |
| 4,836,590 | A | 6/1989 | Swift | |
| 4,887,855 | A | 12/1989 | Tritton et al. | |
| 4,893,853 | A | 1/1990 | Guiler | |
| 4,909,552 | A | 3/1990 | Weber et al. | |
| 4,940,268 | A | 7/1990 | Lesquir et al. | |
| 4,968,075 | A | 11/1990 | Lesquir et al. | |
| 4,991,889 | A * | 2/1991 | Remark | 292/327 |
| 5,005,883 | A * | 4/1991 | Guiler | 292/327 |
| 5,118,148 | A | 6/1992 | Castro Netto | |
| 5,120,097 | A | 6/1992 | Fattori et al. | |
| 5,127,687 | A * | 7/1992 | Guiler | 292/327 |
| 5,180,200 | A | 1/1993 | Georgopoulos et al. | |
| 5,314,219 | A | 5/1994 | Georgopoulos et al. | |
| 5,345,657 | A | 9/1994 | Shimizu | |
| 5,348,180 | A | 9/1994 | Shepard | |
| 5,402,958 | A | 4/1995 | Mahaney | |
| 5,419,599 | A | 5/1995 | Georgopoulos | |
| 5,427,423 | A | 6/1995 | Georgopoulos | |
| 5,452,930 | A | 9/1995 | Morgan | |
| 5,489,034 | A | 2/1996 | Netto | |
| 5,577,395 | A | 11/1996 | Kuykendall | |
| 5,762,386 | A | 6/1998 | Fuehrer | |
| 5,782,513 | A | 7/1998 | Nazzari | |
| 5,788,294 | A | 8/1998 | Leon et al. | |
| 5,871,243 | A | 2/1999 | Wenk | |
| 6,000,736 | A | 12/1999 | Leon | |
| 6,007,121 | A | 12/1999 | Dreisbach | |
| 6,128,932 | A | 10/2000 | Mainetti et al. | |
| D436,015 | S | 1/2001 | Yu | |
| 6,227,016 | B1 | 5/2001 | Yu | |
| 6,265,973 | B1 * | 7/2001 | Brammall et al. | 340/568.1 |
| 6,283,517 | B1 | 9/2001 | Nazzari | |
| D450,560 | S | 11/2001 | Yu | |
| 6,389,854 | B1 | 5/2002 | Huang | |
| 6,390,519 | B1 | 5/2002 | Dreisbach et al. | |
| 6,416,091 | B1 | 7/2002 | Wenk et al. | |
| 6,481,765 | B1 | 11/2002 | Jelavic | |
| 6,550,829 | B1 | 4/2003 | Dobson | |
| 6,578,886 | B1 | 6/2003 | Bystry et al. | |
| 6,578,887 | B1 | 6/2003 | Kienzler | |
| 6,588,812 | B1 | 7/2003 | Garcia | |
| 6,962,376 | B2 | 11/2005 | Palzkill et al. | |
| 6,966,584 | B2 | 11/2005 | Debrody et al. | |
| 6,981,725 | B2 * | 1/2006 | Debrody et al. | 292/307 R |
| 7,118,144 | B2 | 10/2006 | Anderson | |
| 7,131,300 | B1 | 11/2006 | Monasco | |
| D540,149 | S | 4/2007 | Tollefson | |
| 7,226,095 | B2 * | 6/2007 | Huang | 292/327 |
| 7,243,963 | B2 | 7/2007 | Castro | |
| 7,270,353 | B2 * | 9/2007 | Sironi et al. | 292/307 R |
| D556,012 | S | 11/2007 | Tollefson | |
| 7,336,170 | B2 | 2/2008 | Auerbach et al. | |
| 7,370,892 | B2 | 5/2008 | Collingham | |
| 7,438,334 | B2 * | 10/2008 | Terry et al. | 292/327 |
| 7,472,933 | B2 | 1/2009 | Weedon et al. | |
| D597,397 | S | 8/2009 | Nazzari | |
| 7,612,669 | B2 * | 11/2009 | Brigham | 340/568.4 |
| 7,696,886 | B2 * | 4/2010 | Lai | 340/572.7 |
| 7,721,407 | B2 * | 5/2010 | Littrell et al. | 29/509 |
| 7,740,292 | B1 | 6/2010 | Fattori et al. | |
| 8,026,816 | B2 * | 9/2011 | Chao Cheng | 340/572.1 |
| 8,485,572 | B2 | 7/2013 | Nazzari | |
| 8,487,768 | B2 * | 7/2013 | Lee et al. | 340/572.1 |
| 8,544,902 | B2 * | 10/2013 | Remark et al. | 292/319 |
| 8,558,700 | B2 * | 10/2013 | Chen | 340/572.8 |
| 2005/0023844 | A1 | 2/2005 | Huang | |
| 2006/0119111 | A1 | 6/2006 | De Lima Castro | |
| 2007/0007776 | A1 | 1/2007 | Beard et al. | |
| 2007/0040395 | A1 | 2/2007 | Lee | |
| 2007/0210085 | A1 | 9/2007 | Robinson | |
| 2011/0148127 | A1 | 6/2011 | Nazzari | |
| 2011/0210567 | A1 | 9/2011 | Nazzari | |
| 2012/0187701 | A1 * | 7/2012 | Tsai | 292/137 |
| 2013/0026771 | A1 | 1/2013 | Nazzari | |
| 2013/0259598 | A1 * | 10/2013 | Debrody et al. | 411/337 |
| 2013/0277989 | A1 | 10/2013 | Nazzari | |

FOREIGN PATENT DOCUMENTS

| | | | | |
|---|---|---|---|---|
| EP | 1 088 762 | A1 | 4/2001 | |
| EP | 2249328 | | 11/2010 | |
| FR | 2 678 328 | A1 | 12/1992 | |
| FR | 2714991 | A1 * | 7/1995 | G09F 3/03 |
| GB | 2025856 | A * | 1/1980 | G09F 3/03 |
| GB | 2168654 | A | 6/1986 | |
| GB | 2256618 | A * | 12/1992 | G09F 3/03 |
| IT | 660127 | | 1/1964 | |
| WO | 99/22999 | A1 | 5/1999 | |
| WO | WO 0186615 | A2 * | 11/2001 | |
| WO | WO0205613 | | 1/2002 | |
| WO | WO 2010099819 | A1 * | 9/2010 | G09F 3/03 |
| WO | 2010151303 | A1 | 12/2010 | |
| WO | 2013016476 | A1 | 1/2013 | |
| WO | WO2013003929 | | 10/2013 | |

OTHER PUBLICATIONS

International Search Report and Written Opinion Regarding PCT/US97/19166, May 14, 1999.

International Search Report and Written Opinion Regarding PCT/US2010/001749, Aug. 19, 2010.

International Search Report and Written Opinion Regarding PCT/US2012/048225, Oct. 16, 2012.

International Search Report and Written Opinion of the International Searching Authority from corresponding PCT Application No. PCT/US2014/037797, mailed Sep. 18, 2014.

* cited by examiner

LOCK BOLT

FIELD

The present invention relates to a security lock bolt useful to seal objects against unauthorized access, such as containers, meters, doors, covers, and the like.

RELATED ART

Lock bolts are used to secure or seal objects against unauthorized access much in the manner of padlocks and the like, but are specifically intended to reveal tampering with the seal by visual inspection. Thus, lock bolts are typically arranged so that a visual inspection will show that the seal is secure and had not been tampered with in an unauthorized manner from the time it is installed up to the time it is released from the sealed object.

Typical known lock bolts include a lock bolt body and a locking cylinder irreversibly connected together by a locking feature that enables quick and simple assembly of the bolt body to the locking cylinder but prevents later separation of the two elements without breaking all or part of the lock bolt assembly, which breakage will be readily apparent by visual inspection.

Prior art lock bolts are exemplified in the following listed patent documents:

U.S. Pat. No. 409,034—Gillespie
U.S. Pat. No. 1,079,839—Ciernia
U.S. Pat. No. 1,131,085—Reilly
U.S. Pat. No. 4,802,700—Stevenson et al.
U.S. Pat. No. 5,120,097—Fattori et al.
U.S. Pat. No. 6,481,765—Jelavic
U.S. Pat. No. 6,550,829—Dobson
U.S. Pat. No. 6,962,376—Palzkill et al.
U.S. Pat. No. 7,740,292—Fattori
U.S. Pat. No. 7,336,170—Auerbach et al.
US 2007/0007776 A1—Beard et al.
French 0 537 400—Fortin (Apr. 21, 1993)

The prior art lock bolts, while functioning in a manner that provides a locked seal, lack the ability to provide a clearly visible indication of a fully locked condition of a primary internal lock feature between a lock bolt element and a cooperating locking cylinder element, and lack a secondary locking feature that provides a second lock in addition to the primary internal lock between a lock bolt element and a locking cylinder element, while providing a visible indication of a locked condition of the lock bolt and any evidence of tampering with the lock bolt that has interfered with its locked condition.

BRIEF SUMMARY OF THE INVENTION

A lock bolt in accordance with this invention is useable for sealing an object such as a container, vehicle body, meter, access door, etc. against unauthorized access includes an elongate bolt body having an irreversible locking feature such as a circumferential locking groove located at a position along its length and that is receivable in an axially extending bore in a cooperating locking cylinder that includes an irreversible locking feature within the bore, such as a split spring locking ring, adapted to cooperate with the irreversible locking feature on the bolt body when the bolt body is fully received within the locking cylinder bore.

The bolt body is configured to be received within the bore in a manner such that the locking features of the bolt body and the locking cylinder will be coupled and locked together in an irreversible manner once assembled together, and any attempt to separate the bolt body from the locking cylinder will require breaking the bolt body, the locking feature and/or the locking cylinder. Thus, the bolt lock is configured to provide a visible indication of surreptitious interference with its locking and sealing function.

The bolt body and locking cylinder will typically be provided with matching serial numbers or indicia indicating the original unique pairing of lock bolt with locking cylinder.

The lock bolt of the present invention is provided with both a first or primary internal locking feature irreversibly locking the bolt body to the locking cylinder within the cylinder when the bolt body is in the secured assembled configuration, as well as a secondary locking feature locking the bolt body to a casing of the locking cylinder in a manner that is visible to an outside viewer through a transparent cap member covering and coupled with the casing.

The transparent cap member provides part of the secondary locking feature in the form of one or more transparent cap member locking features in the preferred form of visible abutments that cooperate with one or more second bolt body locking features in the preferred form of visible locking fingers provided on the lock bolt body. The transparent cap member is securely locked permanently to the casing of the locking cylinder in a preferred embodiment. Accordingly, the bolt body is secured irreversibly to the locking cylinder when they are assembled in a secured configuration with the bolt body received in the bore of the locking cylinder by two locks, namely a first internal locking feature within the bore of the locking cylinder, usually a split spring metal locking ring element that engages a first bolt body locking feature in the preferred or typical form of a circumferential locking groove on the metal shank of the bolt body, and a second bolt body locking feature in the preferred form of visible locking fingers on the bolt body that engage the visible locking abutments within the transparent cap member covering the upper end of the locking cylinder.

The secondary bolt body locking feature in the preferred form of the visible locking fingers engaging the visible locking abutments of the transparent cap member also provides a tell-tale indication of complete locking of the first internal locking feature by indicating whether the bolt body has been fully received within the locking cylinder bore to a sufficient extent to cause the first internal locking feature (i.e., the split ring and locking groove on the bolt metal shank) to become engaged. The second bolt body locking feature in the preferred form of locking fingers and the transparent cap member locking feature in the form of locking abutments are configured and dimensioned such that they will not become engaged unless the bolt metal shank has been fully received within the locking cylinder bore to the extent that the first bolt body locking feature is irreversibly engaged with the cylinder locking feature.

The lock bolt according to the present invention accordingly provides a doubly secure seal with visible indications of a fully locked condition and visible evidence of any tampering of the lock bolt causing or attempting to cause the bolt body to be separated from the locking cylinder.

The casing on the bolt body and the locking cylinder are formed of relatively rigid and hard resin (plastic) material that is over-molded directly onto the lock bolt and the locking cylinder, with a connector section of the over-molded material, if desired, that temporarily connects the lock bolt to the locking cylinder to keep them together during shipping and handling up to installation in view of the marking of the lock bolt and locking cylinder with a common serial number that ensures matching of bolt to cylinder when the lock bolt is in a sealed condition.

BRIEF DESCRIPTION OF THE DRAWINGS

The invention will be described in detail below with reference to the appended drawings in which.

DETAILED DESCRIPTION OF ILLUSTRATIVE EMBODIMENT

Figure 1:
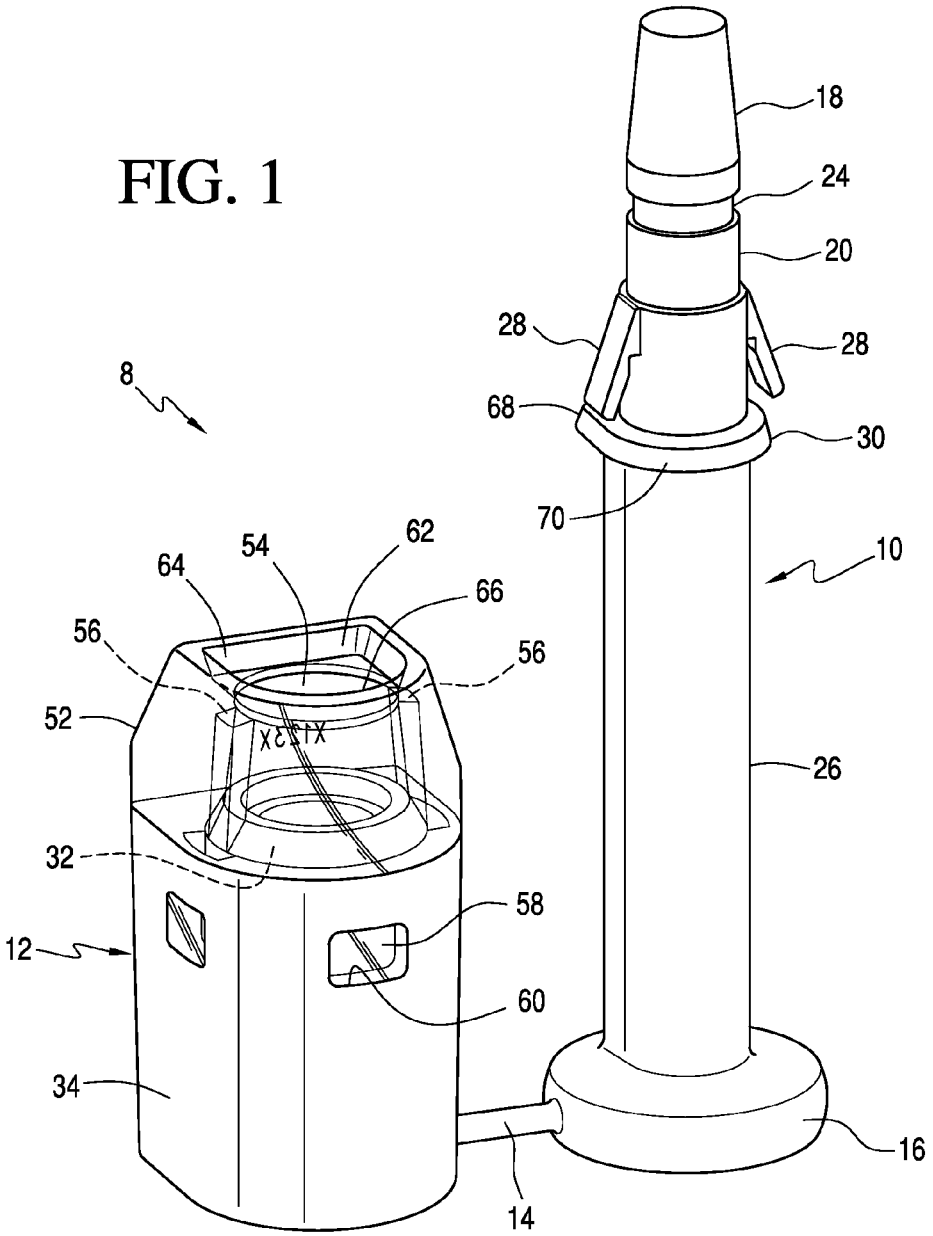
FIG. 1 is a perspective front view of elements of an exemplary lock bolt embodying the invention before assembly in a security locking configuration.
Figure 2:
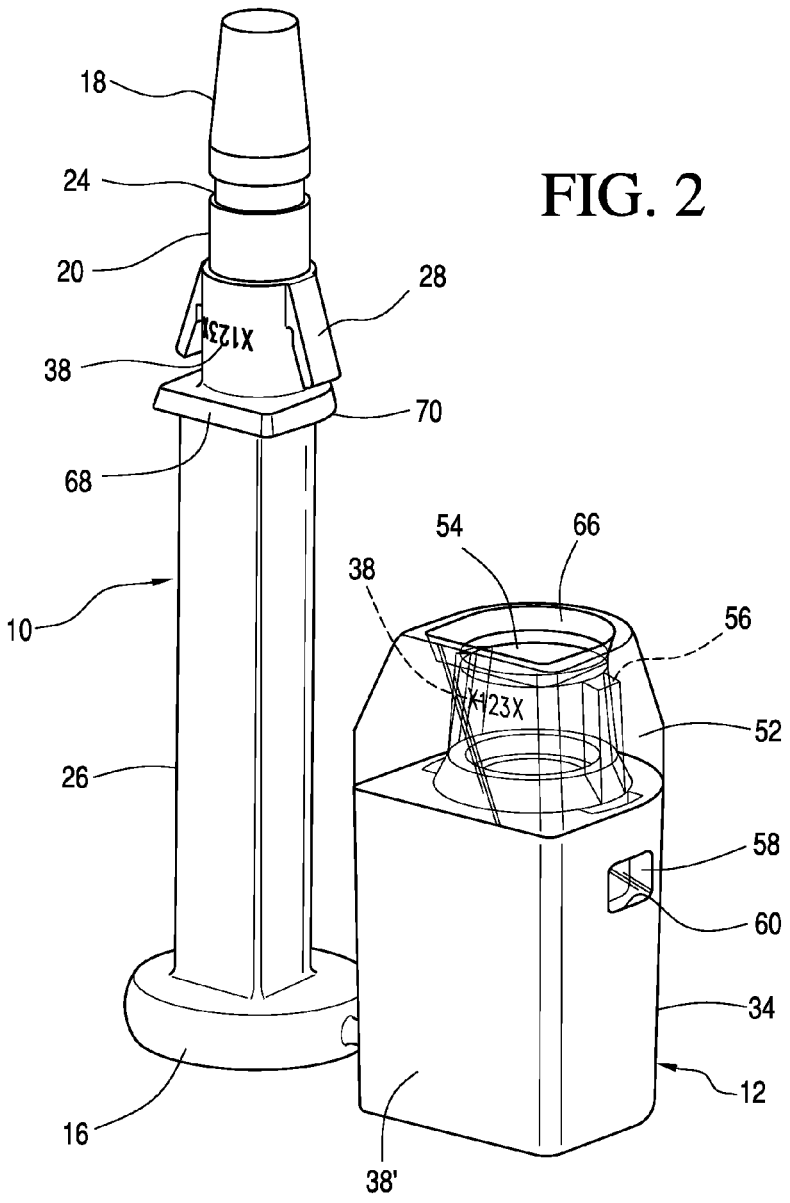
FIG. 2 is a perspective rear view of the elements shown in FIG. 1.
Figure 3:
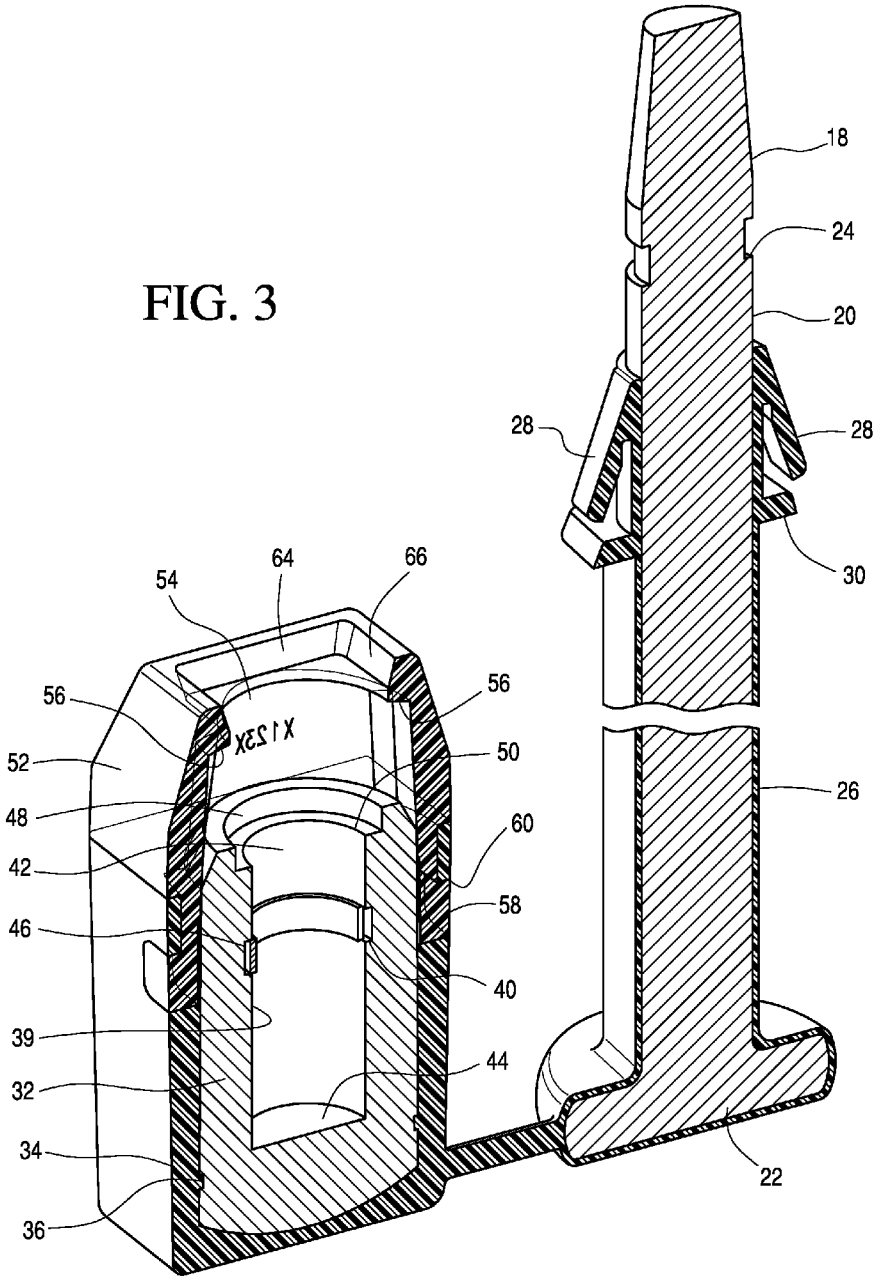
FIG. 3 is perspective front cut away view of the elements of FIG. 1 showing the internal structures of the elements.

With reference to FIGS. 1-3, elements of an illustrative example of a lock bolt 8 embodying the invention are seen to include an elongate axially extending bolt body 10 having a desired length and a locking cylinder 12. The bolt body 10 is intended to cooperate with the locking cylinder 12 to provide a security seal for an object to be locked against intrusion or opening in a manner that will reveal any attempt at such intrusion or opening.

Specifically, the bolt body 10 includes a distal end area that becomes irreversibly locked within the cylinder 12 by a first locking feature (to be described) in the locking cylinder 12 when the bolt body 10 is inserted into the cylinder 12 during a sealing procedure wherein the bolt body 10 is inserted through an opening or structure for receiving the bolt body in an object (e.g., container, vehicle body, meter, access door, etc.) to lock the object against opening or displacement and is locked within the locking cylinder so that the bolt cannot be removed or separated from the locking cylinder without fracturing one or more of the bolt body, the locking cylinder, and the locking element. Thus, the object to be sealed in a secure manner cannot be opened or moved in a manner that will escape detection of overt or surreptitious entry or movement involving damaging or destroying the lock bolt. In accordance with usual practice, when it is desired to release the lock bolt by an authorized party, the bolt body is cut with an appropriate tool (e.g., a bolt cutter) to release the lock bolt from the object and to enable access to the object that was locked or sealed. Accordingly, lock bolts of this kind are usually intended for single use only.

The bolt body 10 is initially formed separate from the locking cylinder 12 as shown in FIG. 1, but is connected as a unit to the locking cylinder 12 by a connector 14 in a manner to be described. The bolt body preferably is made of appropriate steel or other metal that cannot be readily fractured, deformed or broken during normal use in a manner that would interfere with its sealing function. The bolt body further includes an integral enlarged head 16 at its proximal end area for cooperating with an object to be sealed and a tapered distal end 18 that is intended to be locked within the locking cylinder 12. The bolt body 10 includes an internal metal shank 20 and an internal metal head 22 that is integrally formed in one piece with the shank 18 and defines the enlarged head 16. The tapered distal end 18 is an extension of the metal shank and includes a circumferential locking groove 24 formed about the circumference of the shank 20, the purpose and function of which will be described below. The bolt body 10 is formed in a polygonal or squared shape as shown, but this is optional, whereby the cross-section may be in any desired form compatible with the intended use of the lock bolt. The polygonal shape shown possesses the advantage of ease of manipulation and handling of the bolt body 10, and assists the operator in locating the plane in which the locking fingers (identified at 28 in FIG. 1 and to be described below) are located during assembly of the bolt body 10 to the locking cylinder 12.

The bolt body 10 includes an over-molded casing 26 that is formed by molding a relatively hard resinous or plastic material over the metal head 22 and partially over the proximal end of the internal metal shank 20, as shown in FIG. 1. The over-molded casing 26 preferably, although not necessarily, is opaque and includes bendable locking fingers 28 attached in cantilever fashion at one end to the bolt body 10, which are bendable radially inwardly toward the internal metal shank 20 when pressed inwardly in a manner to be described below. Otherwise, the locking fingers 28 are integral with the over-molded casing 26.

A closure cover 30 is also formed by the over-molded casing 26 adjacent the locking fingers 28, and located between the locking fingers and the bolt head 16. The purpose and function of the closure cover 30 will be evident from the description to follow.

The connector 14 is molded with the over-molded casing 26 and is integral with the casing 26. The connector 14 is intended to temporarily retain the bolt body with the locking cylinder 12 during shipping and handling until the bolt body and cylinder are separated in preparation for installation on or in an object to be sealed. In practice, the bolt body 10 and locking cylinder 12 will be provided with a matching serial number 38 applied to both elements to ensure against tampering and alteration of the lock bolt in a manner resulting in substituting a different bolt body from one that was originally associated with a locking cylinder to foil detection by visual inspection of the lock bolt assembly during use.

The locking cylinder 12, as seen in FIG. 1, is initially connected to the bolt body 10 by the temporary connector 14 preferably formed of the material of the over-molded casing 26.

The locking cylinder 12 includes an inner cylinder 32 (see FIG. 3) configured to receive the distal end area of the locking bolt internal metal shank 20, including the tapered distal end portion 18 and the locking groove 24. The inner cylinder 32 is formed of high strength metal similar in a typical embodiment of the lock bolt to the metal used for the internal metal shank and internal metal head of the bolt body 10.

An over-molded casing 34 is provided over the inner cylinder 32, and is secured against separation from the cylinder 32 by molded keys 36 or other features that create a lock against separation between the over-molded casing 3 and inner cylinder 32. The over-molded casing 34 is made of the same material as the over-molded casing 26 of the bolt body, preferably.

Thus, when initially formed, the bolt body 10 and locking cylinder 12 will be a connected assembly wherein the connector 14 temporarily connects the over-molded casing 26 of the bolt body 10 and the over-molded casing 34 of the locking cylinder 12. This facilitates handling and installation as described above, and ensures that each manufactured bolt body remains with each respective manufactured locking cylinder. As mentioned above, the bolt body and locking cylinder are each inscribed with a unique matching serial number 38 or the like for each bolt body and locking cylinder set. The inscriptions, of course, will be provided on inner inaccessible surfaces of the bolt body and the locking cylinder to prevent tampering with the serial number.

The outer contour of the over-molded casing 34 of the locking cylinder 12 may include a planar rear side 38' as shown in FIG. 2 and a generally arcuate front side as shown in FIG. 1, although the outer shape of the locking cylinder may be selected on the basis of aesthetics or functionality depending on the desired or intended use of the lock bolt.

The inner cylinder 32, as seen in FIG. 3, includes an inner cylinder bore 39 that is provided with an undercut circumferential groove 40 between the open end 42 of the inner cylinder bore and a closed bottom end 44 of the inner cylinder bore. A split locking ring 46, typically a strong spring metal, is provided in the groove 40 (see FIG. 3). The manner in which the locking ring 46 and the locking groove 24 cooperate will be explained in detail below. The inner diameter of the locking ring 46 when it is in its relaxed state is smaller than the inner diameter of the cylinder bore 39, as illustrated in FIG. 3, for example, and is also smaller in this state than the outer diameter of the internal metal shank 20 of bolt body 10. The split locking ring 46 is located within an internal circumferential recess within the inner cylinder bore 39 that is dimensioned so that the split ring can expand radially outwardly so that its inner diameter will be about the same as the inner diameter of the cylinder bore 39, while the split ring 46 is captured within the circumferential recess when the ring 4 is in its normal relaxed state.

Thus, when the lock bolt is to be assembled to the locking cylinder, the tapered distal end 18 of the metal shank 20 of the bolt body 10 may be received within the cylinder bore 39 until the tapered distal end 18 engages the split lock ring 46, at which point continued insertion of the distal end 18 into the inner cylinder bore 39 urges the split ring into a radially expanded condition to enable the metal shank 20 to continue to be inserted within the bore 39 until the circumferential locking groove 24 reaches a position opposite the split ring 46. At this point, the split ring 46 will snap by spring action into a contracted configuration towards its relaxed state so that its inner diameter is now smaller than the outer diameter of the metal shank 20 on either side of the locking groove 24, so that the metal shank 20 is now captured irreversibly within the locking cylinder 12 by the split ring 46.

The open end 42 of the inner cylinder 32 includes an undercut recess 48 that terminates at radial shoulder or abutment 50.

The locking cylinder 12 includes a transparent cap member 52 having an axial opening 54 aligned with the inner cylinder bore 39. The cap member 52 is formed of a transparent rigid resinous (plastic) material having suitable strength characteristics to cooperate with the locking fingers 28 in a manner to be described to provide a second lock function for the lock bolt when it is fully assembled and locked together during use as a security seal.

More specifically, the cap member 52 includes a cap member locking feature in the preferred form of a pair of cap locking abutments 56 diametrically opposed from each other on opposite sides of the axial opening 54 in a preferred embodiment. The cap locking abutments 56 present a pair of generally horizontally extending stop surfaces that will cooperate with distal ends of the bolt body locking fingers 28 when the internal metal shank 20 of bolt body 10 is inserted into the inner cylinder bore 39 of the inner cylinder 32, as will be explained below. While only two locking fingers 28 and a pair of locking abutments 56 are illustrated in a preferred embodiment, this is exemplary only, and more than two locking fingers and respective cooperating locking abutments could be provided in accordance with the invention herein disclosed.

The cap member 52 in the exemplary form illustrated in the drawings is connected to the over-molded casing 34 of the locking cylinder 12 by at least one radial projection 58 (preferably three as shown) that closely fits within at least one cooperating radial opening 60 in the over-molded casing 34, with each projection 58 and the adjacent body of the cap member 30 disposed between an outer wall of the inner cylinder 32 and the adjacent over-molded casing 34 as best seen in FIG. 3. Preferably, three projections 58 are located within a corresponding plurality of openings 60, as shown in FIGS. 1-3. Thus, once formed, the cap member 52 is tightly held onto the locking cylinder 12 and cannot be separated from the locking cylinder without breaking the cap member 52 or the over-molded casing 34 or both, which would reveal tampering with the lock bolt. The cap member 52 may be formed by injection molding the cap member to the over-molded casing 34 of the locking cylinder with the projections 58 molded directly into the openings 60, as shown in FIG. 6.

The openings 60 may be through holes as shown, or internal depressions or sockets (not shown) that can receive the projection or projections 58. When the through holes are provided as openings 60 they have the advantage of enabling visible inspection of the projections 58 and the presence of the metal inner cylinder 32.

The transparent cap member 52 is provided preferably with top recess 62 that is intended to receive the closure cover 30 when the internal metal shank 20 is fully inserted into the inner cylinder bore 39. The closure cover 30 effectively closes the axial opening 54 when the shank 20 is fully inserted into the cylinder bore 39 to thereby prevent tampering with the locking fingers 28 when the shank 20 is inserted fully into the cylinder bore 39 and locked therein in a manner that will be evident in the description to follow. The top recess 62 is preferably formed with shape that will cooperate with a shape of the closure cover 30 so that the cover will only fit one way into the recess. In this manner, the cover and recess serve as an index to ensure that the locking fingers 28 will be aligned with the cap member locking abutments 56 when the metal shank 20 is inserted into the inner cylinder bore 39 of the locking cylinder 12 for sealing an object. In the illustrated example the top recess 62 is provide with a flat upstanding edge 64 and an arcuate upstanding edge 66 that corresponds to similar shaped marginal portions 68, 70, respectively, of the closure cover 30 (see FIG. 2).

Figure 4:
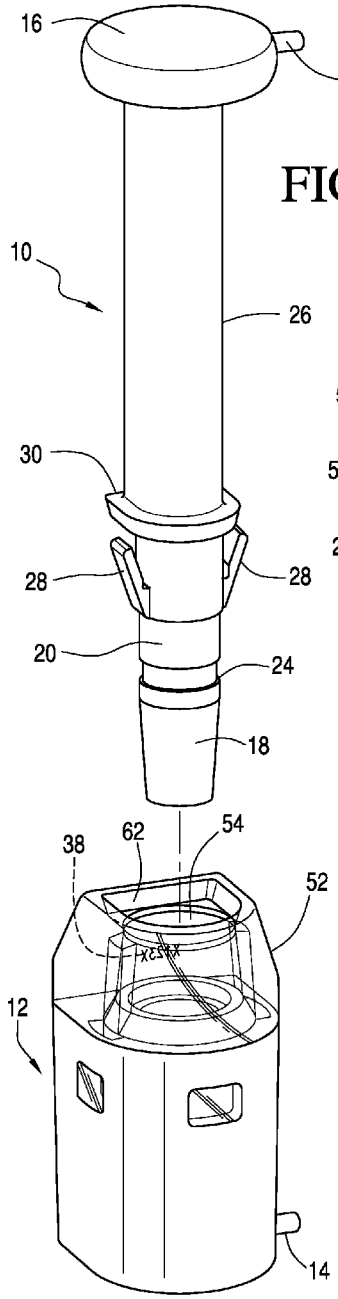
FIG. 4 is a perspective front cut away view of the elements of FIG. 1 in process of being assembled into a locking configuration.
Figure 5:
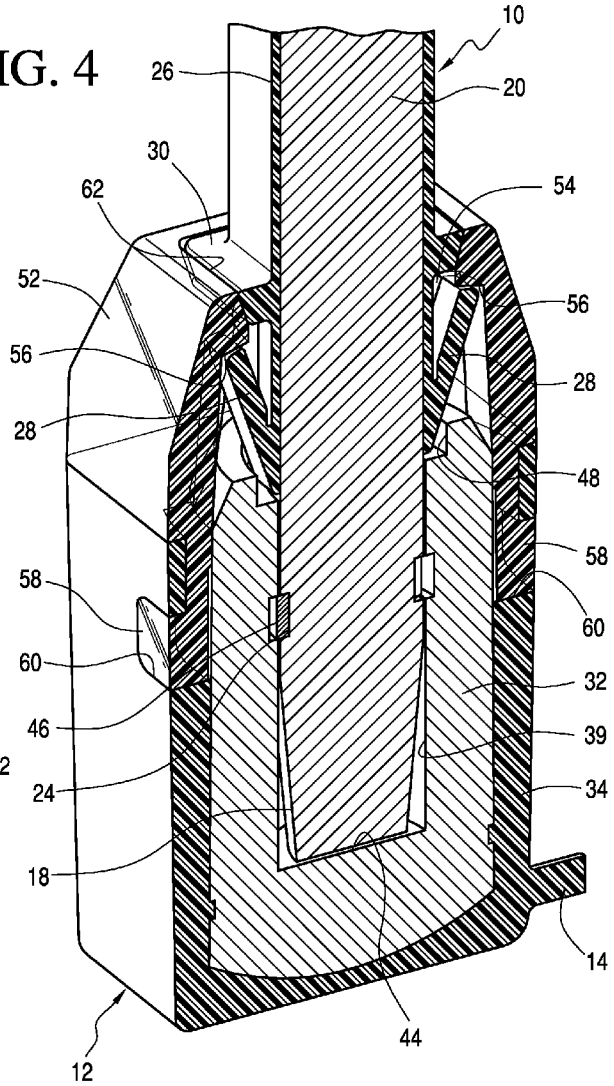
FIG. 5 is a partial front cut away view of the internal structure of part of the lock bolt and the locking cylinder elements in locked configuration.
Figure 6:
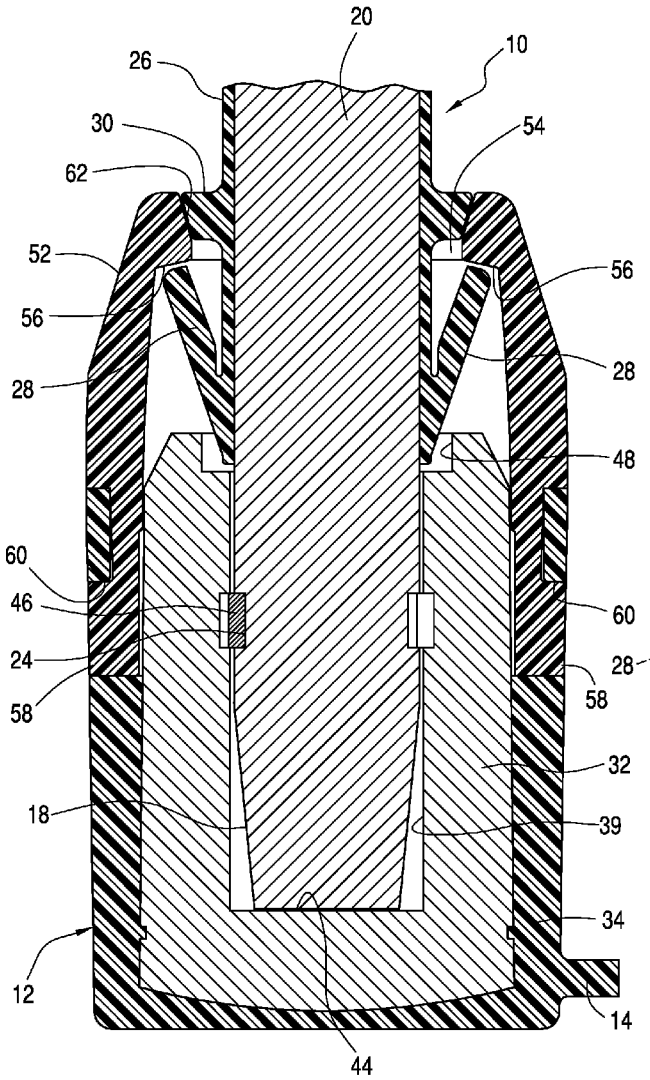
FIG. 6 is an enlarged detail cut away view of the second bolt locking feature fingers and the transparent cap member as shown in FIG. 5, with the lock bolt shank locked in the cylinder bore of the locking cylinder by the split locking ring engaged with the locking groove of the bolt shank.

In use, as shown in FIGS. 4-6, the bolt body 10 is separated from the locking cylinder 12 at the connector 14 which is simply broken apart by a pulling or twisting motion to free the bolt body from the locking cylinder. Up to this time, the bolt body and locking cylinder have been produced, packaged and shipped as a single unit preferably in order to keep the two parts together given that they share a common serial number 38.

The bolt body is manipulated to cooperate with an object to be sealed (not shown), typically a hasp or other element associated with the object to be sealed, such as a closure, door, cover, etc. by placement of the bolt body 10 through an opening of the hasp or element of the object to be sealed and then inserting the distal end 18 of the bolt body 10 through the transparent cap member 52 and into the locking cylinder 12 (see FIG. 4) until the circumferential locking groove 24 is opposite the split locking ring 46, which as described above, has been slightly opened in elastic fashion during passage of the tapered distal end 18 through the locking ring 46. The split ring 46 will then snap back into a normal smaller diameter form when the locking groove 24 is located opposite the locking ring 46 to engage the locking groove 24 (see FIGS. 5 and 6). Thus, the metal shank 20 becomes irreversibly locked against withdrawal from the inner cylinder bore 39 by the locking ring 46 when the locking ring 46 and locking groove 24 are engaged together. When the locking ring 46 and locking groove 24 are engaged together, the position of the lock bolt body 10 relative to the locking cylinder 12 is such that the locking fingers 28 will become lodged beneath the cap abutments 56. The normal relaxed position of the locking fingers 28, as illustrated in FIG. 4 is such that the distal ends of the fingers extend wider than or beyond the diameter of the axial opening 54 of the transparent cap member 52, so that insertion of the over-molded casing 26 and the locking fingers 28 of the bolt body 10 through the axial opening 54 until the locking ring 46 engages the locking groove 24 requires the fingers 28 to be resiliently and elastically bent radially inwardly toward the central axis of the lock bolt body 10 as they pass through the axial opening 54.

The cap member locking abutments 56 are configured and dimensioned to be positioned so that the distal ends of the locking fingers 28 will snap back radially outwardly relative to the axis of the lock bolt body 10 just when they pass the locking abutments 56 as the bolt body 10 moves into the locking cylinder 12 towards a fully inserted position when the locking ring 46 engages the locking groove 24. At this position, the locking fingers 28 likewise engage the locking abutments 56 of the cap member 52 in an irreversible manner to provide a secondary locking together of the bolt body 10 and the locking cylinder 12. Also, the closure cover 30 in this position of bolt body full insertion will fit closely within the top recess 62 of the transparent cap member 52 to effectively seal the axial opening 54 of the cap member. The distal tapered end 18 of the bolt body 10 in the fully inserted position will be located at or closely adjacent the cylinder bottom end 44 and the proximal ends of the locking fingers 28 will be disposed in the undercut recess 48 of the inner cylinder 32 (see FIGS. 5 and 6). The internal metal shank 20 and inner cylinder bore 39 are dimensioned so that the terminal end of the metal shank will extend approximately to the bottom of the bore 39 when the metal shank is locked within the cylinder bore 39 by the primary locking feature, namely the split locking ring 46 and the undercut groove 40. While the metal shank 20 is illustrated as extending up to the bottom of the bore 39, it will be understood that in practice a clearance may be desired between the shank 20 and the bottom of the bore 39 to ensure that the split ring 46 will be fully engaged with the locking groove 24 of the metal shank 20 despite manufacturing tolerances that could result in slight variations in the dimensions of the shank 20, bore 39 and the other locking elements of the lock bolt.

With the bolt body 10 fully inserted into the locking cylinder 12, the secondary locking feature embodied in this example by the locking fingers 28 engaging the cap locking abutments 56 of the transparent cap member will be openly visible for remote inspection and due to the geometry of the spacing between the distal ends of the locking fingers 28 and the locking groove 24, on the one hand, and the relative position of the locking abutments 56 relative to the locking cylinder 12, on the other hand, the position of the locking fingers 28 relative to the abutments 56 will provide a visible indication that the locking ring 46 is fully engaged with the locking groove 24. Moreover, if for any reason (such as malicious tampering with the lock bolt before assembly) the locking ring 46 has been removed from the inner cylinder 32 during assembly, the secondary lock provided by the locking fingers 28 engaged with the locking abutments 56 will ensure that the bolt body 10 is retained in the locking cylinder 12 and a visible inspection of such secondary locking feature will be provided by the transparent cap member 52 which enables remote viewing of the position of the locking fingers 28 relative to the locking abutments 56.

Any tampering with the lock bolt assembly when fully locked together in an attempt to separate the bolt body 10 from the locking cylinder 12 will be evident due to the transparent cap member 52 which will reveal at least tampering with the locking fingers 28.

Figure 7:
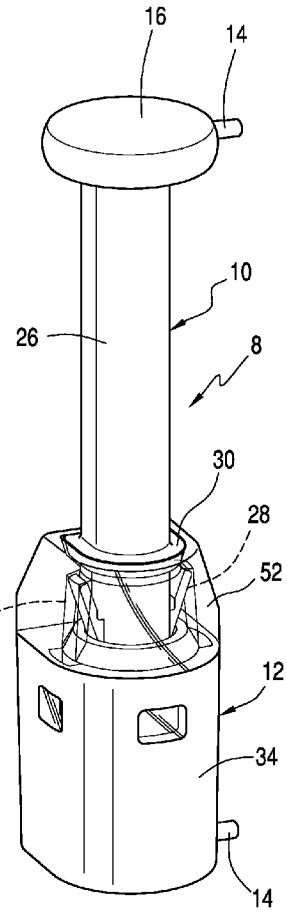
FIG. 7 is a perspective front view of the lock bolt in fully locked configuration.

The fully assembled and locked lock bolt 8 is shown in FIG. 7.

The description and illustration herein of an exemplary lock bolt embodying the invention is not intended to limit the scope of the invention to the specific structure described and shown, but rather is intended to describe an example of the invention which is encompassed by the claims appended hereto. For example, while a specific type of a first bolt body locking feature in the form of the split locking ring 46 that cooperates with a circumferential locking groove 24 of the bolt body 10 is described, any suitable form of irreversible locking arrangement that meets any applicable specification for such a lock bolt could be used as the first locking feature.

Likewise, while a locking finger arrangement 28 is used as a second locking feature associated with the lock bolt, any suitable irreversible locking arrangement could be used for the second locking feature that would serve the purpose of both indicating engagement of the first locking feature and integrity of the second locking feature to secure the bolt body 10 against separation from the locking cylinder 12 independently of and in addition to the first locking feature.

While the transparent cap member 52 is illustrated and described as a separate member molded onto the locking cylinder over-molded casing 34, it is contemplated that the cap member could be integrated with the casing 34 as a single piece or otherwise permanently joined to the casing 34 as a separate member. Moreover, while the locking fingers 28 are described as being integrated with the bolt body casing 26, they could be separately formed and permanently connected to or integrated with the bolt body 10.

What is claimed:

1. A lock bolt comprising:

a bolt body extending axially along a length and having a proximal end area and a distal end area, said bolt body comprising a metal;

said bolt body including a first bolt body locking feature located on the bolt body along its length;

a locking cylinder comprising metal having an inner cylinder bore that has an open end;

a cylinder locking feature associated with the locking cylinder along a length of the inner metal cylinder bore;

said inner metal cylinder bore dimensioned to axially receive the bolt body with the first bolt body locking feature;

said first bolt body locking feature and said cylinder locking feature arranged to be irreversibly coupled to each other when the bolt body is fully received in the inner cylinder bore;

a transparent cap member having an axial opening that is separate from and axially spaced from the inner cylinder bore open end, said transparent cap member being connected to the locking cylinder in a locked relationship with the axial opening aligned with the inner cylinder bore open end;

said transparent cap member comprising at least one visible transparent cap member locking feature located within the transparent cap member;

an over-molded resin or plastic bolt body casing permanently attached to said bolt body and covering a portion of the proximal end area of the bolt body, said bolt body casing including a second bolt body locking feature located between the proximal end area of the bolt body and the first bolt body locking feature, said second bolt locking feature engaging said visible transparent cap member locking feature in an irreversible manner when the first bolt body locking feature is irreversibly coupled to the cylinder locking feature, said bolt body casing arranged to close said axial opening of the transparent member when the first bolt locking feature is irreversibly coupled to the cylinder locking feature.

2. The lock bolt according to claim 1, including a locking cylinder resin or plastic over-molded casing permanently attached to said locking cylinder, said transparent member irreversibly connected to and locked to said locking cylinder casing.

3. The lock bolt according to claim 2 said bolt body casing including a closure cover between the second bolt locking feature and the proximal end area of the bolt body, said closure cover closing said axial opening of the transparent member when the first bolt locking feature is irreversibly coupled to the cylinder locking feature.

4. The lock bolt according to claim 1, said first bolt locking feature comprising an elastically expandable split ring located within the cylinder bore and a circumferential locking groove on the bolt body, and said second bolt locking feature comprising radially elastically bendable locking fingers on the bolt body, said locking fingers arranged to pass through said axial opening in a one-way manner during movement of the bolt body into the inner cylinder bore and to cooperate with said transparent cap member locking feature upon complete passage of the locking fingers through said axial opening.

5. The lock bolt according to claim 1, including a locking cylinder resin or plastic over-molded casing permanently attached to said locking cylinder; and a connector connecting the bolt body casing and the locking cylinder casing; said connector configured to be easily manually unconnected to thereby provide a temporary connection between the bolt body and the locking cylinder before assembly of the lock bolt in a locked condition with the locking cylinder; said bolt body casing and said locking cylinder casing being provided with matching lock bolt identifiers.

6. A lock bolt comprising:

a bolt body extending axially along a length and having a proximal end area and a distal end area, said bolt body comprising a metal;

said bolt body including a first bolt body locking feature located on the bolt body along its length;

a locking cylinder comprising metal having an inner cylinder bore that has an open end;

a cylinder locking feature associated with the locking cylinder along a length of the inner metal cylinder bore;

said inner metal cylinder bore dimensioned to axially receive the bolt body with the first bolt body locking feature;

said first bolt body locking feature and said cylinder locking feature arranged to be irreversibly coupled to each other when the bolt body is fully received in the inner cylinder bore;

a transparent cap member having an axial opening that is separate from and axially spaced from the inner cylinder bore open end, said transparent cap member being connected to the locking cylinder in a locked relationship with the axial opening aligned with the inner cylinder bore open end;

said transparent cap member comprising at least one visible transparent cap member locking feature located within the transparent cap member;

an over-molded resin or plastic bolt body casing permanently attached to said bolt body and covering a portion of the proximal end area of the bolt body, said bolt body casing including:

a second bolt body locking feature located between the proximal end area of the bolt body and the first bolt body locking feature, said second bolt locking feature engaging said visible transparent cap member locking feature in an irreversible manner when the first bolt body locking feature is irreversibly coupled to the cylinder locking feature; and a closure cover between the second bolt locking feature and the proximal end area of the bolt body, said closure cover closing said axial opening of the transparent member when the first bolt locking feature is irreversibly coupled to the cylinder locking feature.

* * * * *